US009876262B2

(12) United States Patent
Subedi et al.

(10) Patent No.: US 9,876,262 B2
(45) Date of Patent: Jan. 23, 2018

(54) MULTI RESONATOR NON-ADJACENT COUPLING

(71) Applicant: Intel Corporation, Santa Clara, CA (US)

(72) Inventors: Purna C. Subedi, Irvine, CA (US); Ian Burke, Lake Forest, CA (US); Vien Van Tran, Bedford, NH (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/452,186

(22) Filed: Mar. 7, 2017

(65) Prior Publication Data

US 2017/0179559 A1 Jun. 22, 2017

Related U.S. Application Data

(63) Continuation of application No. 14/500,440, filed on Sep. 29, 2014.

(Continued)

(51) Int. Cl.

| | |
|---|---|
| ***H01P 1/205*** | (2006.01) |
| ***H01P 1/208*** | (2006.01) |
| ***H01P 7/04*** | (2006.01) |

(52) U.S. Cl.

CPC ..... *H01P 1/2053* (2013.01); *H01P 1/208* (2013.01); *H01P 7/04* (2013.01)

(58) Field of Classification Search

CPC ..... H01P 1/205; H01P 1/2053; H01P 7/04; H01P 1/208

(Continued)

(56) References Cited

U.S. PATENT DOCUMENTS

| | | | |
|---|---|---|---|
| 5,262,742 | A | 11/1993 | Bentivenga |
| 5,748,058 | A | 5/1998 | Scott |

(Continued)

FOREIGN PATENT DOCUMENTS

| | | | |
|---|---|---|---|
| CN | 105556839 | A | 5/2016 |
| DE | 2218277 | A1 | 10/1973 |

(Continued)

OTHER PUBLICATIONS

J. Brain Thomas, "Cross-Coupling in Coaxial Cavity Filters—A Tutorial Overview", Apr. 8, 2003, IEEE Transaction on Microwave Theory and Techniques, vol. 51, Issue 4, pp. 1368-1376.*

(Continued)

*Primary Examiner* — Benny Lee
*Assistant Examiner* — Jorge Salazar, Jr.
(74) *Attorney, Agent, or Firm* — Schwegman Lundberg & Woessner, P.A.

(57) ABSTRACT

A coupling is provided for coupling non-adjacent resonators of a radio frequency filter. The coupling joins together non-adjacent resonators with a metal strip. The metal strip is physically connected to but electrically isolated from resonators located between the connected non-adjacent resonators. The metal strips include tabs the length of which may be varied. The coupling works with different resonator configurations including horizontally aligned resonators. The coupling allows for the jumping of an even number of resonators can produce zeros at high and low bands. A single coupling of this configuration enables two negative couplings.

18 Claims, 6 Drawing Sheets

Related U.S. Application Data

(60) Provisional application No. 61/883,706, filed on Sep. 27, 2013.

(58) Field of Classification Search
USPC ..... 333/203, 204, 205, 206, 207, 222, 223
See application file for complete search history.

(56) References Cited

U.S. PATENT DOCUMENTS

| | | | | |
|---|---|---|---|---|
| 6,262,639 | B1 | 7/2001 | Shu et al. | |
| 6,664,872 | B2 * | 12/2003 | Channabasappa | H01P 1/205 333/202 |
| 7,583,936 | B2 | 9/2009 | Kovacs et al. | |
| 9,692,098 | B2 | 6/2017 | Subedi et al. | |
| 2002/0070820 | A1 | 6/2002 | Walker et al. | |
| 2007/0273459 | A1 | 11/2007 | Puoskari et al. | |
| 2010/0029241 | A1 | 2/2010 | Morga et al. | |
| 2014/0292446 | A1 * | 10/2014 | Chiu | H01P 7/04 333/203 |
| 2015/0091672 | A1 | 4/2015 | Subedi et al. | |

FOREIGN PATENT DOCUMENTS

| | | | |
|---|---|---|---|
| DE | 2218277 | B2 | 12/1977 |
| EP | 0069651 | A1 | 1/1983 |
| FR | 2509535 | A1 | 1/1983 |
| WO | WO-2015048650 | A1 | 4/2015 |

OTHER PUBLICATIONS

"U.S. Appl. No. 14/500,440, Examiner Interview Summary dated Jan. 23, 2017", 3 pgs.
"U.S. Appl. No. 14/500,440, Non Final Office Action dated Apr. 7, 2016", 8 pgs.
"U.S. Appl. No. 14/500,440, Non Final Office Action dated Oct. 27, 2016", 7 pgs.
"U.S. Appl. No. 14/500,440, Notice of Allowance dated Feb. 15, 2017", 10 pgs.
"U.S. Appl. No. 14/500,440, Response filed Jun. 24, 2016 to Non Final Office Action dated Apr. 7, 2016", 7 pgs.
"U.S. Appl. No. 14/500,440, Response Filed Jan. 16, 2017 to Non Final Office Action dated Oct. 27, 2016", 8 pgs.
"International Application Serial No. PCT/US2014/058053, International Preliminary Report on Patentability dated Apr. 7, 2016", 6 pgs.
"International Application Serial No. PCT/US2014/058053, International Search Report dated Jan. 9, 2015", 2 pgs.
"International Application Serial No. PCT/US2014/058053, Written Opinion dated Jan. 9, 2015", 4 pgs.
Wang, et al., "True Inline Cross-Coupled Coaxial Cavity Filters", IEEE, vol. 57, (Dec. 2009), 2958-2965.
"U.S. Appl. No. 14/500,440, Corrected Notice of Allowance dated Jun. 2, 2017", 3 pgs.
"Chinese Application Serial No. 201480046249.4, Office Action dated May 31, 2017", w/English Translation, 12 pgs.
"European Application Serial No. 14849074.1, Extended European Search Report dated Mar. 31, 2017", 7 pgs.
"European Application Serial No. 17156259.8, Invitation pursuant to Rule 63(1) EPC dated Jul. 4, 2017", 5 pgs.
"Chinese Application Serial No. 201480046249.4, Response filed Oct. 9, 2017 to Office Action dated May 31, 2017", (W/ English Claims), 10 pgs.
"European Application Serial No. 14849074.1, Response filed Oct. 24, 2017 to Extended European Search Report dated Mar. 31, 2017", 17 pgs.
"European Application Serial No. 17156259.8, Extended European Search Report dated Nov. 28, 2017", 10 pgs.

* cited by examiner

MULTI RESONATOR NON-ADJACENT COUPLING

CROSS-REFERENCE TO RELATED APPLICATIONS

This application is a continuation of U.S. patent application Ser. No. 14/500,440, filed Sep. 29, 2014, now U.S. Pat. No. 9,692,098 B2 Published on Jun. 27, 2017, which application claims priority to U.S. Provisional Patent Application Ser. No. 61/883,706 filed on Sep. 27, 2013, which applications and publications are incorporated herein by reference in their entirety.

BACKGROUND OF THE INVENTION

1. Field of the Invention

The present invention relates to resonators. More particularly, the present invention relates to couplings among a plurality of resonators. Still more particularly, the present invention relates to coupling between or among non-adjacent resonators.

2. Description of the Prior Art

Non-adjacent coupling between resonators in RF filters is a widely established technique to achieve transmission zeros at desired frequencies and thus establish sharp rejections in certain frequency ranges without increasing the number of resonators. Most of the real world applications require non-symmetrical frequency response; i.e., one side of the frequency band has much higher rejection requirements than the other and thus the ability to place transmission zeros arbitrarily at desired frequencies can produce both symmetric and non-symmetric frequencies. This very ability allows us to reduce filter sizes while minimizing insertion loss and at the same time increasing rejections in desired frequencies. Some of the techniques to couple non-adjacent cavities are to bring non-adjacent cavities physically closer, but this approach may not always be possible or be impractically difficult due to geometry constraints.

SUMMARY OF THE INVENTION

The present invention mitigates the problem of coupling together non-adjacent resonators including in situations with geometric constraints. It does so by providing a configuration that enables the coupling of non-adjacent cavities including, but not limited to, when the cavities are arranged in straight lines.

In one embodiment, the present invention is a radio frequency (RF) filter including three or more resonators, the RF filter comprising a coupling contacting a first of the three or more resonators and a second of the three or more resonators, wherein the first and the second resonator are not adjacent to one another, and wherein the coupling is connected to but electrically isolated from each resonator of the three or more resonators positioned between the first and second resonators. The coupling includes a metal strip in physical contact with a surface of the first resonator and a surface of the second resonator and a non-conductive spacer between the metal strip and a surface of each resonator of the three or more resonators positioned between the first and second resonators. The thickness of the spacer is selectable. The metal strip includes one or more tabs for contacting the first and second resonators. The lengths of the tabs are selectable. The metal strip may contact the first and second resonators at a selectable location thereon.

In another embodiment, the invention is a RF filter including five or more resonators, the RF filter comprising a first coupling contacting a first of the five or more resonators and a second of the five or more resonators, wherein the first and the second resonator are not adjacent to one another, and wherein the first coupling is connected to but electrically isolated from each resonator of the five or more resonators positioned between the first and second resonators, and a second coupling contacting the second resonator and a third of the five or more resonators, wherein the second and third resonator are not adjacent to one another, and wherein the second coupling is connected to but electrically isolated from each resonator of the five or more resonators positioned between the second and third resonators. The first coupling includes a first metal strip in physical contact with a surface of the first resonator and a surface of the second resonator and a non-conductive spacer between the metal strip and a surface of each resonator of the five or more resonators positioned between the first and second resonators, and wherein the second coupling includes a second metal strip in physical contact with the surface of the second resonator and a surface of the third resonator and a non-conductive spacer between the second metal strip and a surface of each resonator of the five or more resonators positioned between the second and third resonators. The thickness of each of the spacers is selectable. The first metal strip includes one or more tabs for contacting the first and second resonators and the second metal strip includes one or more tabs for contacting the second and third resonators. The lengths of the tabs are selectable. The first metal strip may contact the first and second resonators at a selectable location thereon and the second metal strip may contact the second and third resonators as a selectable location thereon.

The features and advantages of the invention will become further apparent upon review of the following detailed description, the accompanying drawings and the appended claims that describe the invention.

DETAILED DESCRIPTION OF THE INVENTION

Figure 1A:
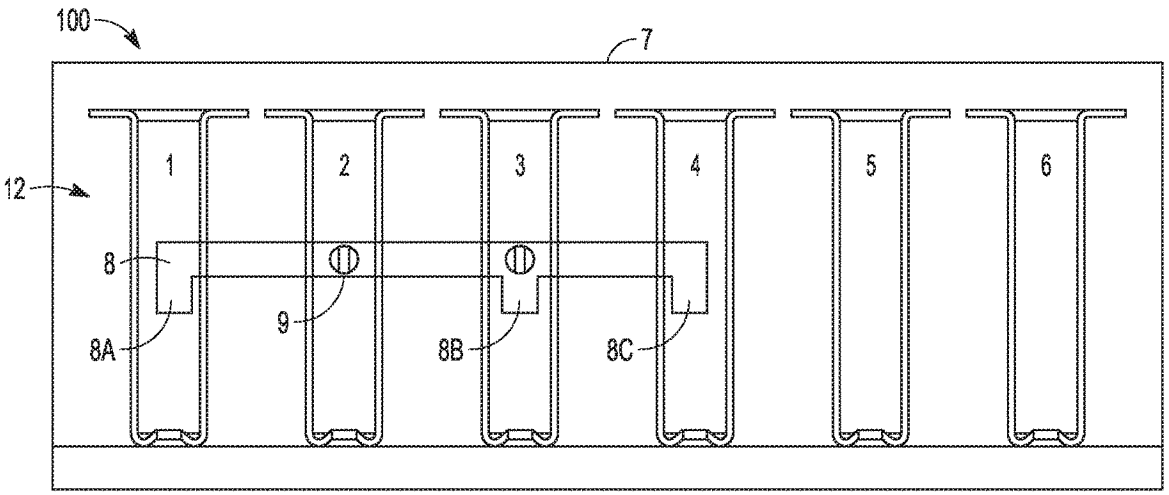
FIG. 1A is a front view of a multi resonator filter with a first embodiment of the coupling of the present invention showing a set of six resonator cavities and a single coupling element.
Figure 1B:
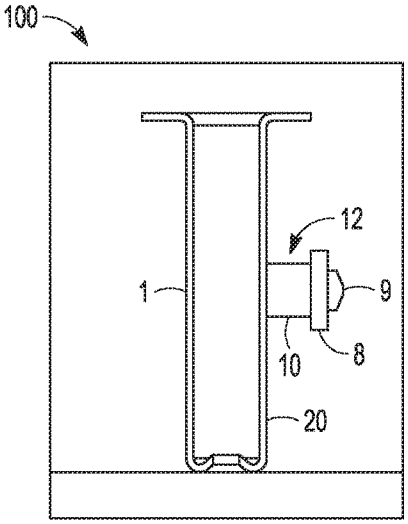
FIG. 1B is a side view of the multi resonator filter of FIG. 1A.

In reference to FIGS. 1A and 1B, a multi resonator filter 100 includes a set of six resonators, resonators 1-6, that are metal resonators with resonator cavities either forming part of resonator housing 7 or that are mechanically bolted or bonded to the housing 7. The housing 7 may be a metal housing. The filter 100 further includes a first embodiment of a coupling 12 that is formed of a metal strip 8 and non-conductive (dielectric) spacers 10 fastened together with non-conductive (dielectric) screws 9. The spacers 10 space the metal strip 8 from a surface 20 of the resonators 2 and 3. That is, the configuration of coupling 12 couples resonators 1 and 4 and allows the jumping in doing so of resonators 2 and 3.

The present invention works with any resonator configuration; however, it is more practical when the resonators are laid out horizontally, i.e., the resonators are accessible from the sides normally with a removable side cover of the housing 7.

Normally, a positive coupling between two resonator cavities jumping an odd number of cavities produces a zero in the high side of the band and a negative coupling produces a zero in the low side of the band. But, in the case of a negative coupling using the coupling 12 of the present invention, jumping an even umber of resonators, i.e., coupling from resonator 1 to resonator 4 (thereby jumping the two resonators 2 and 3), can produce two zeros, one at the lower side of the band and the other at the higher side of the band. With this even resonator jumping negative cross coupling, the level of zeros on each side of the band can be grossly differently with only one side of the zero being fully controllable for the frequency position. Placing another negative coupling from resonator 1 to 2 (or 2 to 4), enables control of the placement of zeros at the lower side of the bands. Similarly, placing a positive coupling from resonator (1 to 2 (or 2 to 4)), enables control of the higher side zero. The ability allows to fully control both side of the zeros. Normally, having two negative couplings requires two cross coupling elements. That is not necessary with the present invention.

Normally, when the distance between resonators is less than one-quarter wavelength, an open ended transmission line that is a certain distance away from the resonator that is cross coupled produces a negative coupling and physically shorting each end to the resonator that is being coupled will produce a positive coupling. In the configuration of the invention shown in FIGS. 1A and 1B, just the one metal strip 8 produces non adjacent negative coupling between resonators 1 to 3 and (also 2 to 4) while also producing a negative coupling between resonators 1 and 4. The tab lengths 8*a*, 8*b* and 8*c* are of selectable length, allowing for the tuneability of respective coupling values. The filter tuneability can also be managed by placing the metal strip 8 either towards the top or the bottom of the surface 20 of the resonators.

Figure 2:
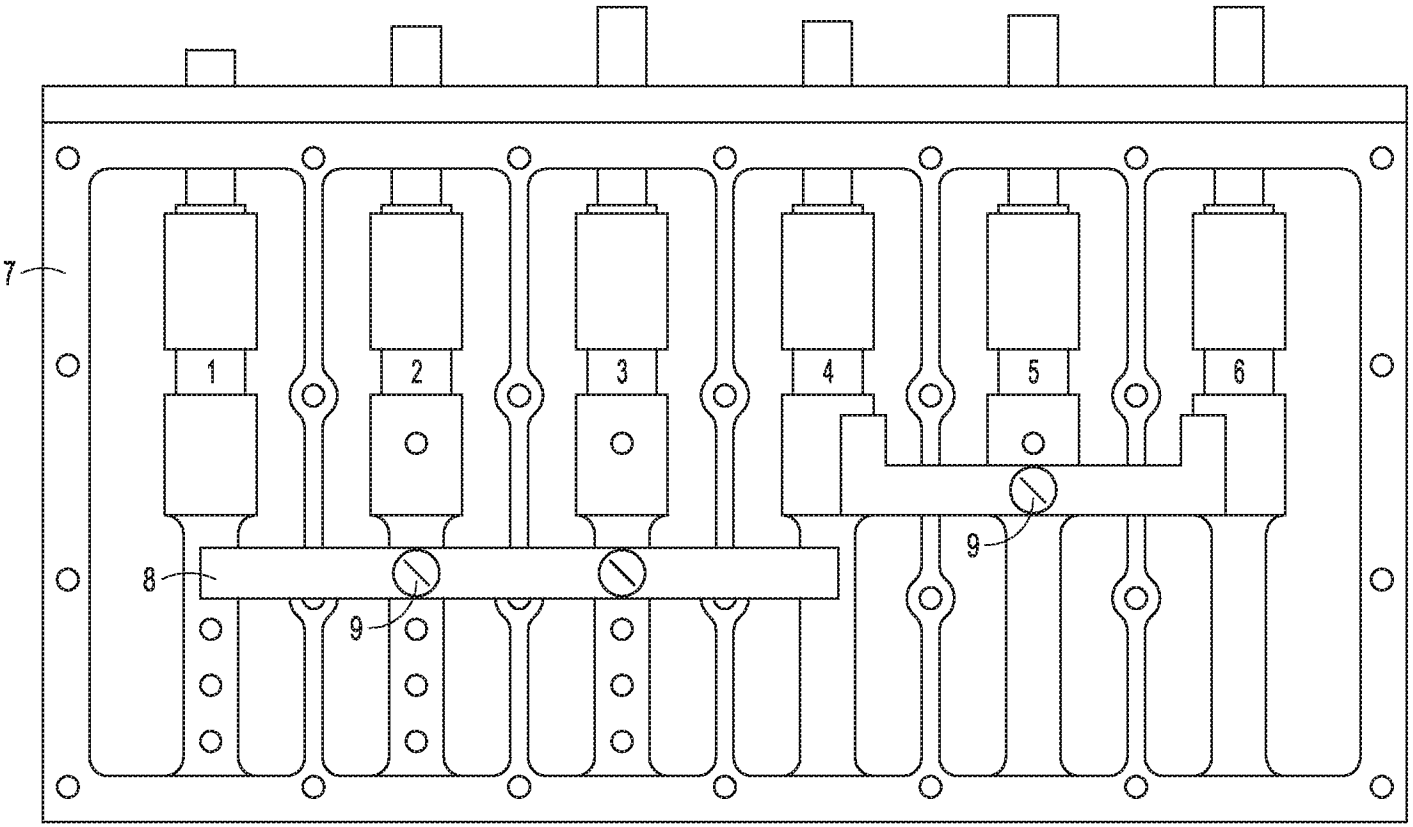
FIG. 2 is a front view of a multi resonator filter with a second embodiment of the coupling of the present invention showing the same set of six resonator cavities of FIGS. 1A and 1B with the coupling including two coupling elements.

A second embodiment of coupling 24 is shown in FIG. 2 for resonator filter 200. The resonator filter 20 includes the same six resonators 1-6 of FIGS. 1A and 1B. The coupling 24 also includes the coupling 12 of FIGS. 1A and 1B plus additional coupling element 26, which is a second metal strip coupling resonator 4 to resonator 6. For the geometry of the resonator filter 200 of FIG. 2, the measured coupling bandwidth values in frequency are:

Resonators 1-3=2.1 MHz
Resonators 1-4=3.3 MHz
Resonators 2-4=7.5 MHz The coupling bandwidth values for couplings 1-3 and 2-4 are also controllable by adjusting the spacing, i.e., making a thickness of the spacer 10 thicker or thinner so as to adjust the gap between the metal strip 8 and the surface 20 of the resonator cavity.

Figure 3:
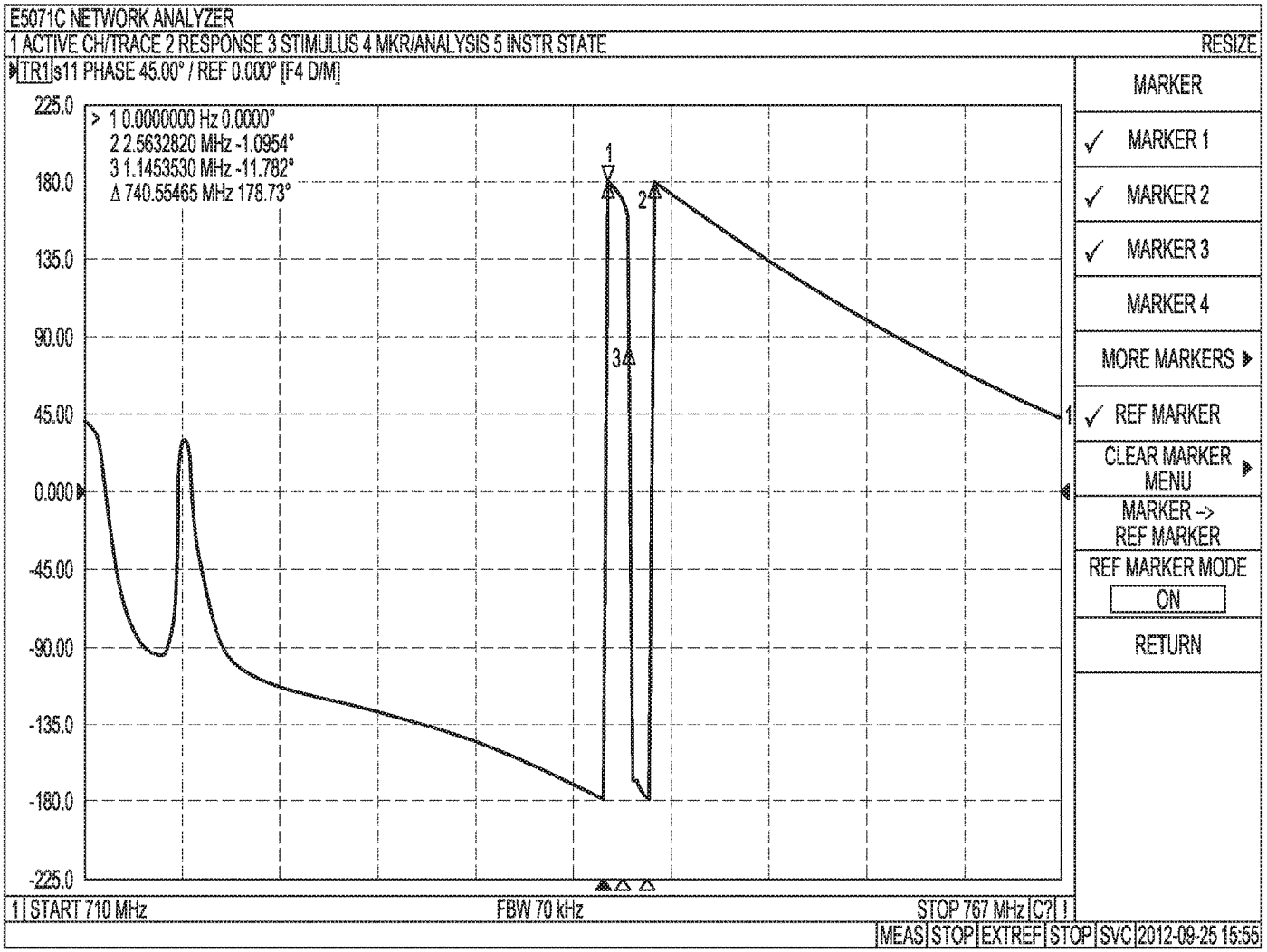
FIG. 3 is a graph showing the phase response from resonator 1 to resonator 3 of the resonator filter of FIG. 2.
Figure 4:
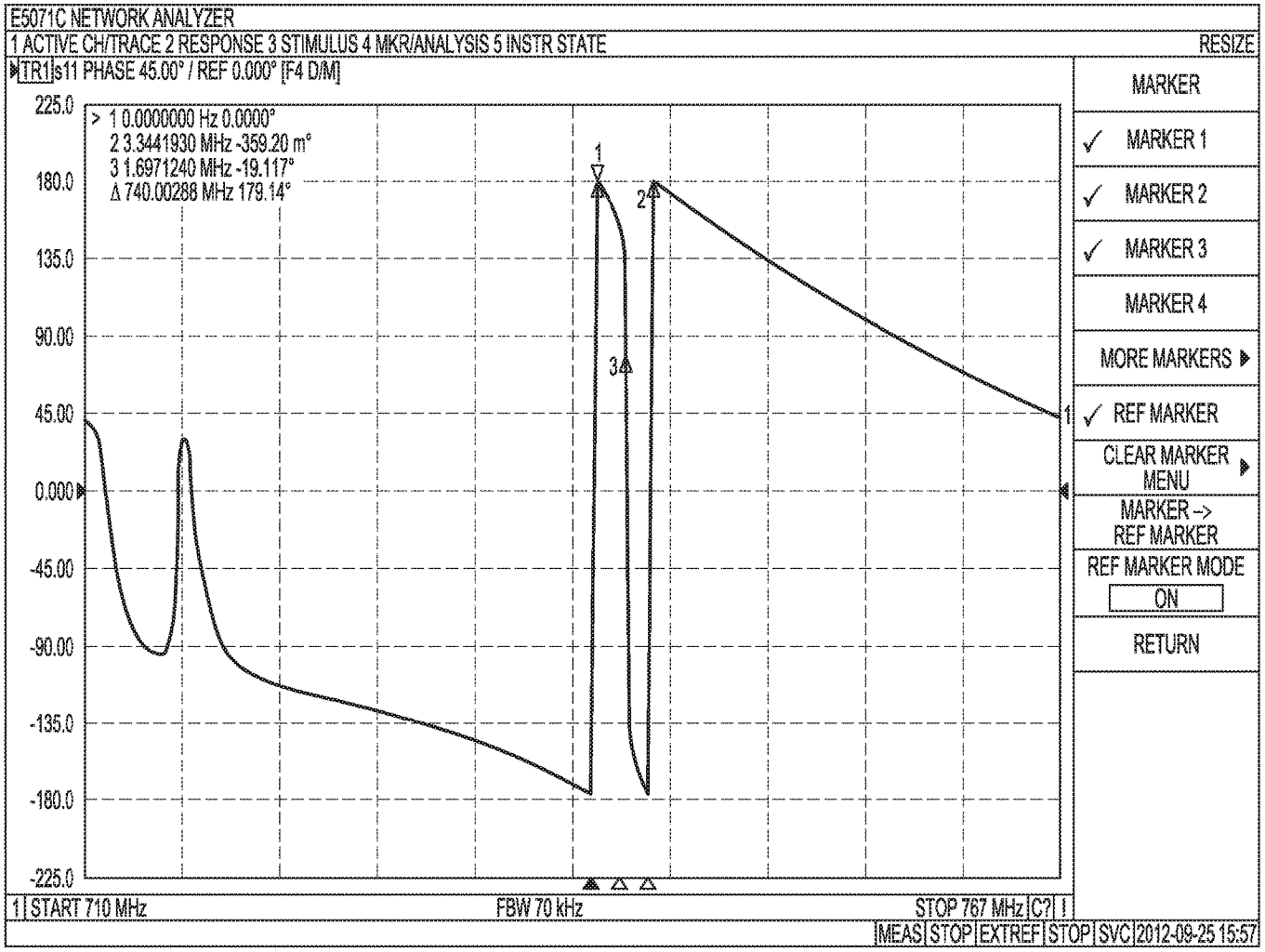
FIG. 4 is a graph showing the phase response from resonator 1 to resonator 4 of the resonator filter of FIG. 2.
Figure 5:
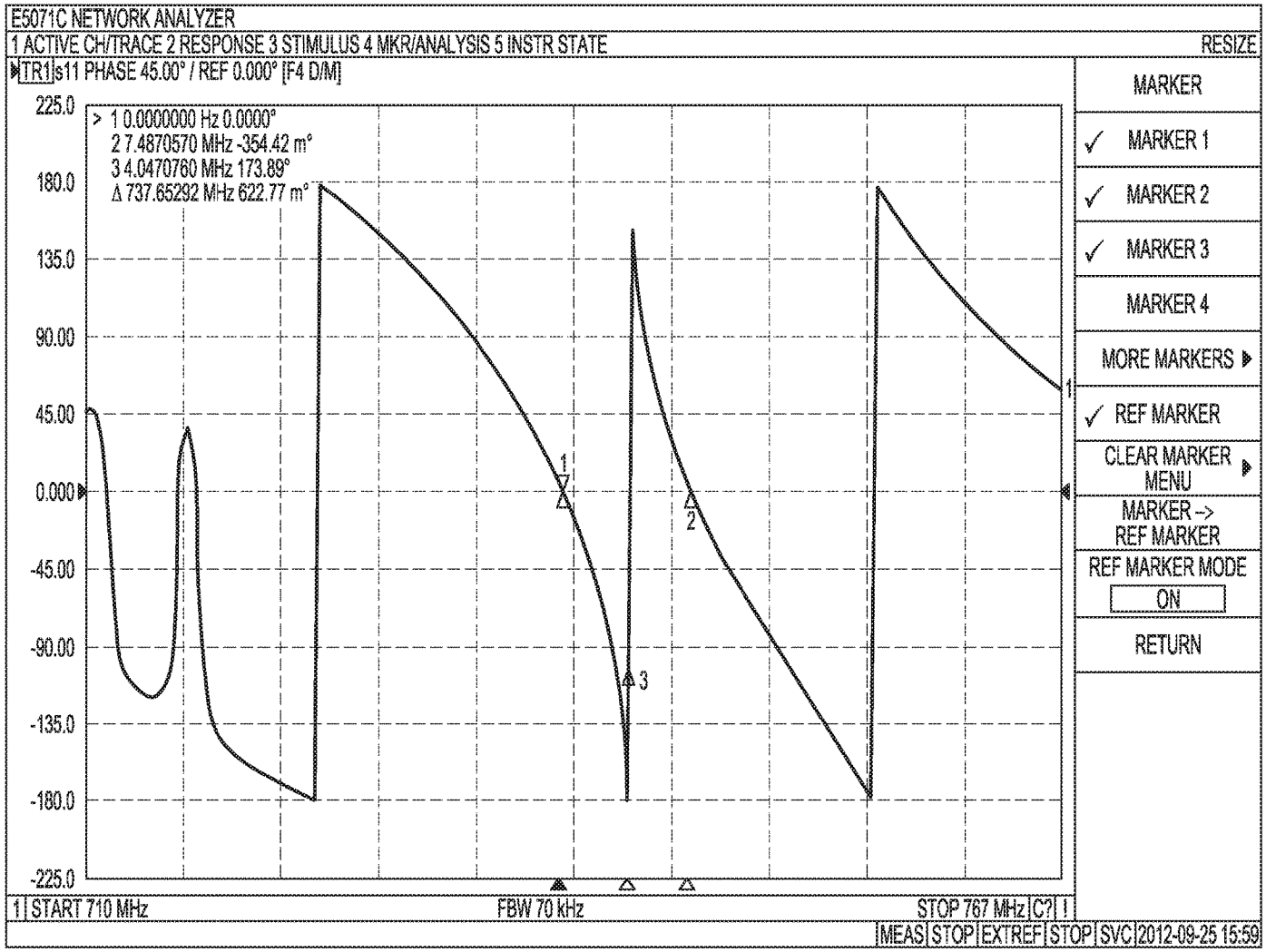
FIG. 5 is a graph showing the phase response from resonator 2 to resonator 4 of the resonator filter of FIG. 2.
Figure 6:
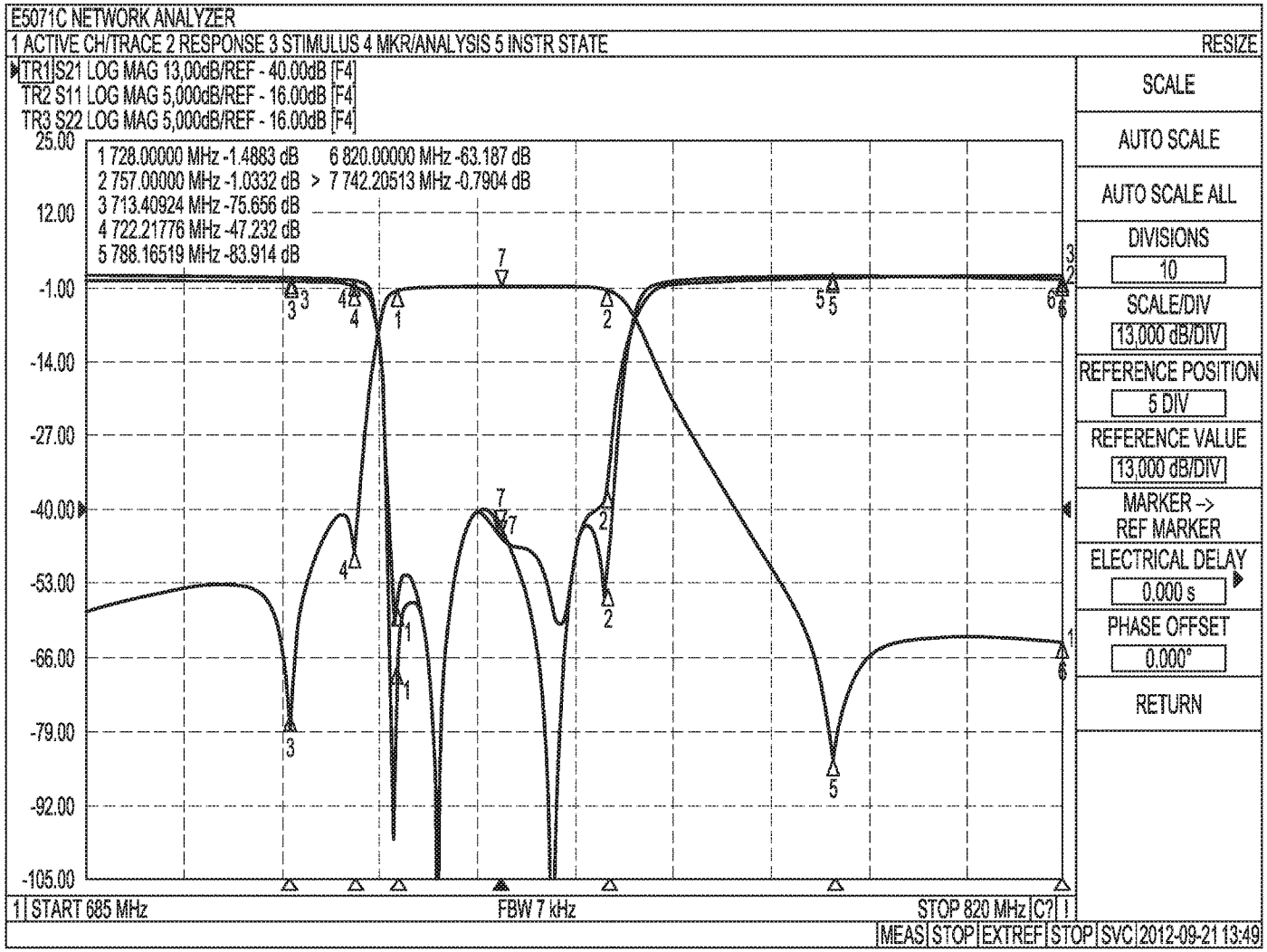
FIG. 6 is a graph showing the measured frequency response of the resonator filter of FIG. 2.

Measured phase responses for the coupling bandwidths of Resonators 1-3, 1-4 and 2-4 using the coupling 12 of FIGS. 1A and 1B and the corresponding coupling element of coupling 24, are given in FIGS. 3-5. FIG. 6 shows the output of a completely tuned filter of resonator filter 200 of FIG. 2, including the impact of the negative coupling between resonators 4 and 6 with coupling element 26. The plot of FIG. 6 clearly shows three transmission zeros.

The present invention has been described with reference to a specific embodiment but is not intended to be so limited. The scope of the invention is defined by the appended claims.

What is claimed is:

1. A radio frequency (RF) filter, comprising:

a plurality of resonators including a first resonator, a second resonator and a third resonator; and a cross-coupling element between the first resonator and the second resonator, the cross-coupling element extending over the third resonator and being galvanically isolated from the third resonator via an electric insulator, wherein the first and the second resonators are non-adjacent to each other, the third resonator positioned between the first and second resonators, and wherein the cross-coupling element comprises a plurality of tabs extending over the first and second resonators, the plurality of tabs capacitively coupling the cross-coupling element to the first resonator and the second resonator.

2. The RF filter of claim 1, wherein the plurality of resonators comprise a fourth resonator, the cross-coupling element extending over the third and fourth resonators, and being galvanically isolated from the third and fourth resonators, and wherein the fourth resonator is between the third resonator and the second resonator.

3. The RF filter of claim 1, wherein lengths of the plurality of tabs are selectable.

4. The RE filter of claim 1, wherein the cross-coupling element is galvanically separated from a surface of the first resonator and a surface of the second resonator.

5. The RF filter of claim 4, wherein a thickness of the electric insulator is selectable.

6. The RF filter of claim 1, wherein the cross-coupling element includes a metal strip in contact with a surface of the electric insulator.

7. The RF filter of claim 1, wherein a first tab of the plurality of tabs extends over the first resonator, and a second tab of the plurality of tabs extends over the second resonator, and wherein the first and second tabs are orthogonal to a portion of the cross-coupling element extending over the third resonator.

8. The RF filter of claim 1, wherein the cross-coupling element comprises an electrically conductive signal line coupling the plurality of tabs.

9. The RF filter of claim 1, further comprising:

an input terminal coupled to the first resonator, the input terminal for receiving an input RF signal; and an output terminal coupled to the third resonator, wherein the plurality of resonators filter the input signal to generate an output signal at the output terminal.

10. The RF filter of claim 1, wherein a first tab of the plurality of tabs extends over the first resonator so that a first gap is provided between the first tab and the first resonator, a second tab of the plurality of tabs extends over the second resonator so that a second gap is provided between the second tab and the second resonator, the first gap and the second gap for achieving the capacitive coupling.

11. A radio frequency (RF) filter, comprising:

a plurality of resonators including a first resonator, a second resonator and a third resonator; and a cross-coupling element between the first resonator and the second resonator, the cross-coupling element attached to at least one of the plurality of resonators, the cross-coupling element extending over the third resonator and being galvanically separated from the first resonator and the second resonator via an electric insulator, wherein the first and the second resonators are non-adjacent to each other, the third resonator positioned between the first and second resonators, wherein the cross-coupling element comprises a first tab extending over the first resonator, a second tab extending over the second resonator, the tabs capacitively coupling the cross-coupling element to the first resonator and the second resonator, and wherein the first and second tabs are orthogonal to a portion of the cross-coupling element extending over the third resonator.

12. The RF filter according to claim 11, wherein a distance from the cross-coupling element to the first and second resonators is selectable to change capacitive coupling between the cross-coupling element and the first and second resonators.

13. The RF filter according to claim 11, wherein a distance from the first and second tabs to respective surfaces of the first and second resonators are selectable to change the capacitive coupling.

14. A radio frequency (RF) filter, comprising:

a plurality of resonators including a first resonator, a second resonator, a third resonator, a fourth resonator, and a fifth resonator;

a first cross-coupling element between the first resonator and the second resonator, the cross-coupling element extending over the third resonator and being galvanically isolated from the third resonator, wherein the first and the second resonators are non-adjacent to each other, the third resonator positioned between the first and second resonators, and a second cross-coupling element positioned between the fourth resonator and the fifth resonator, wherein the first cross-coupling element comprises a first plurality of tabs extending over the first and second resonators, the first plurality of tabs capacitively coupling the first cross-coupling element to the first resonator and the second resonator, and wherein the second cross-coupling element comprises a second plurality of tabs extending over the fourth and fifth resonators, the second plurality of tabs capacitively coupling the second cross-coupling element to the fourth resonator and the fifth resonator.

15. The RF filter according to claim 14, wherein a first tab of the first plurality of tabs extends over the first resonator, and a second tab of the first plurality of tabs extends over the second resonator, and wherein the first and second tabs are orthogonal to a portion of the cross-coupling element extending over the third resonator.

16. The RF filter according to claim 15, wherein a position of the first cross-coupling element is adjustable in relation to a surface of the first resonator and a surface of the second resonator to change capacitive coupling between the first cross-coupling element and the first and second resonators.

17. The RF filter according to claim 16, wherein a position of the first tab and the second tab of the first plurality of tabs is adjustable in relation to the surface of the first resonator and the surface of the second resonator to change the capacitive coupling.

18. The RF filter according to claim 14, wherein a first tab of the second plurality of tabs extends over the fourth resonator, and a second tab of the second plurality of tabs extends over the fifth resonator.

* * * * *